US007484352B2

(12) United States Patent
Flohr et al.

(10) Patent No.: US 7,484,352 B2
(45) Date of Patent: Feb. 3, 2009

(54) COMBUSTOR FOR A GAS TURBINE

(75) Inventors: Peter Flohr, Turgi (CH); Bruno Schuermans, Basel (CH); Majed Toqan, Abu Dhabi (AE)

(73) Assignee: ALSTOM Technology Ltd., Baden (CH)

( * ) Notice: Subject to any disclaimer, the term of this patent is extended or adjusted under 35 U.S.C. 154(b) by 92 days.

(21) Appl. No.: 11/533,796

(22) Filed: Sep. 21, 2006

(65) Prior Publication Data

US 2007/0163267 A1 Jul. 19, 2007

Related U.S. Application Data

(63) Continuation of application No. PCT/EP2005/051229, filed on Mar. 17, 2005.

(30) Foreign Application Priority Data

Mar. 29, 2004 (DE) ..... 10 2004 015 187

(51) Int. Cl.
*F02C 9/28* (2006.01)

(52) U.S. Cl. ..... 60/39.281; 60/725; 60/746

(58) Field of Classification Search ..... 60/39.281, 60/725, 746, 747; 431/114
See application file for complete search history.

(56) References Cited

U.S. PATENT DOCUMENTS

| | | | |
|---|---|---|---|
| 5,303,542 A | 4/1994 | Hoffa | |
| 5,402,634 A * | 4/1995 | Marshall | 60/747 |
| 6,205,764 B1 | 3/2001 | Hermann et al. | |
| 6,370,863 B2 | 4/2002 | Mueller et al. | |
| 6,425,239 B2 | 7/2002 | Hoffmann et al. | |

(Continued)

FOREIGN PATENT DOCUMENTS

| | | |
|---|---|---|
| DE | 19636093 | 3/1998 |

(Continued)

OTHER PUBLICATIONS

Search Report for German App. No. 10 2004 015 187.3 (Mar. 30, 2005).

(Continued)

*Primary Examiner*—Louis J Casaregola
(74) *Attorney, Agent, or Firm*—Cermak Kenealy Vaidya & Nakajima LLP; Adam J. Cermak

(57) ABSTRACT

In a combustor (1) for a gas turbine, the combustor (1) includes a burner system (2) and a fuel supply system (3). The burner system (2) includes at least two burner groups (A, B) each with at least one burner (5). The fuel supply system (3) includes a main line (7), which is connected to a fuel source (8), and also an auxiliary line (9) for each burner group (A, B). Each auxiliary line (9) is connected to each burner (5) of the associated burner group (A, B) and is connected to the main line (7) by a controllable distribution valve (10). A sensing system (11) measures pressure pulsation values and/or emission values for each burner group (A, B). A control system (12), in dependence upon the pulsation values and/or the emission values, controls the distribution valves (10) so that in each burner group (A, B) the pulsation values and/or the emission values assume and/or fall below predetermined threshold values.

10 Claims, 2 Drawing Sheets

U.S. PATENT DOCUMENTS

| | | | |
|---|---|---|---|
| 6,584,775 | B1 | 7/2003 | Schneider et al. |
| 2004/0025512 | A1 | 2/2004 | Davis, Jr. et al. |

FOREIGN PATENT DOCUMENTS

| | | |
|---|---|---|
| DE | 19934612 | 1/2001 |
| EP | 0962704 | 12/1999 |
| EP | 1050713 | 11/2000 |
| EP | 1180646 | 2/2002 |
| WO | WO02/052201 | 7/2002 |
| WO | WO02/061335 | 8/2002 |

OTHER PUBLICATIONS

International Search Report for PCT Patent App. No. PCT/EP2005/051229 (Jul. 29, 2005).

* cited by examiner

COMBUSTOR FOR A GAS TURBINE

This application is a Continuation of, and claims priority under 35 U.S.C. § 120 to, International patent application number PCT/EP2005/051229, filed 17 Mar. 2005, and claims priority therethrough under 35 U.S.C. § 119 to German application no. 10 2004 015 187.3, filed 29 Mar. 2004, the entireties of both of which are incorporated be reference herein.

BACKGROUND OF THE INVENTION

1. Field of the Invention

The invention under consideration relates to a combustor for a gas turbine and, in addition, relates to an associated operating method.

2. Brief Description of the Related Art

U.S. Pat. No. 6,370,863 B2 discloses a combustor for a gas turbine, which has a burner system which has a plurality of burner groups with a plurality of burners in each case. Furthermore, a fuel supply system is provided, which has a main line which is connected to a fuel source, and also, for each burner group, an auxiliary line which is connected to each burner of the associated burner group and connected to the main line by a controllable distribution valve. In addition, a combustion chamber is provided, with the burners being installed at its inlet. In the disclosed combustor, the individual burners are operable in a pilot mode and in a premix mode, wherein within one burner group all the burners are constantly operated either in the premix mode or in the pilot mode. According to the operating mode, the burners require more or less fuel, which is adjustable by the distribution valves. The operation of the distribution valves takes place in the disclosed combustor in dependence upon the respective load state of the combustor.

To achieve emission values for pollutants which are as low as possible, the burners are operated as lean as possible at the nominal operating point of the combustor. By means of the lean operation, the homogenous combustion reaction, which is in process in the combustion chamber, leads to comparatively low temperatures. Since the formation of pollutants, especially the formation of $NO_x$, depends disproportionately on the temperature, the low combustion temperatures lead to a reduction of the pollutant emissions. On the other hand, it has been shown that a homogenous temperature distribution in the combustion chamber promotes the creation of pressure pulsations. Thermoacoustic pressure pulsations, on the one hand, lead to a noise nuisance, and on the other hand, can disadvantageously influence the combustion reaction. In an extreme case, strong pressure pulsations can extinguish the flame in the combustion chamber. In this case, it has been shown that with less lean, or with rich fuel-oxidant mixtures, the combustion reaction is less susceptible to thermoacoustic instabilities. Especially, zones with rich combustion can stabilize adjacent zones with lean combustion.

EP 1 050 713 A1 discloses a method for suppression or control, as the case may be, of thermoacoustic oscillations in a combustor, in which the aforementioned oscillations are detected in a closed control loop, and acoustic oscillations of a defined amplitude and phase are generated in dependence upon the detected oscillations and are coupled into the combustion chamber. By this measure, the thermoacoustic oscillations are suppressed or reduced, as the case may be, if within the control loop the amplitude of the generated acoustic oscillations is selected to be proportional to the amplitude of the detected oscillations. By this method, therefore, the thermoacoustic oscillations which arise in defined operating situations are damped.

SUMMARY OF THE INVENTION

One aspect of the present invention deals with the problem of showing a way for improving the operating method for a combustor of the type mentioned above, wherein especially the development of pressure pulsations and/or the emission of pollutants are to be reduced.

Another aspect of the present invention is based on the general ideas of determining associated values for pressure pulsations and/or pollutant emissions for each burner group, and controlling the fuel feed to the burner groups in dependence upon these values. According to one of numerous principles of the present invention, this is realized by a sensing system which separately measures the values for the pressure pulsations and/or emissions for each burner group, and provides a control system which, in dependence upon these pulsation values or emission values respectively, controls, activates, or operates, as the case may be, distribution valves which control the fuel flow to the individual burner groups. In this case, the controlling or operating, respectively, of the distribution valves takes place so that in each burner group the pulsation values and/or the emission values assume or fall below predetermined threshold values, as the case may be.

Another aspect of the present invention includes that the burner system, during the operation of the combustor, can be operated with a view to pollutant emissions which are as low as possible, and additionally or alternatively with a view to pressure pulsations which are as low as possible.

According to an advantageous embodiment, the operation of the distribution valves does not take place directly in dependence upon the pulsation values or the emission values, as the case may be, but takes place indirectly by means of proportional factors which, for the respective burner group, represent the portion of a predetermined total fuel flow to be fed to the combustion chamber which is fed to this burner group. The control system determines a proportional factor for each burner group in dependence upon the pulsation values and/or emission values, and, therefore, controls the distribution valves in dependence upon these proportional factors. This procedure simplifies the management of the distribution valves or their operation, as the case may be. The realization of an important variant, in which the control system determines the proportional factors so that the total fuel flow remains constant, is especially simplified by this. In this embodiment, the closed-loop control of the fuel flows for the burner groups does not affect, or only slightly affects, the performance of the combustor.

Further important features and advantages of the invention are apparent from the drawings and from the associated figure descriptions with reference to the drawings.

BRIEF DESCRIPTION OF THE DRAWINGS

Preferred exemplary embodiments of the invention are shown in the drawings and are explained in detail in the subsequent description, wherein like designations refer to the same components, or to similar components, or to functionally the same components. In each drawing.

DETAILED DESCRIPTION OF EXEMPLARY EMBODIMENTS

Figure 1:
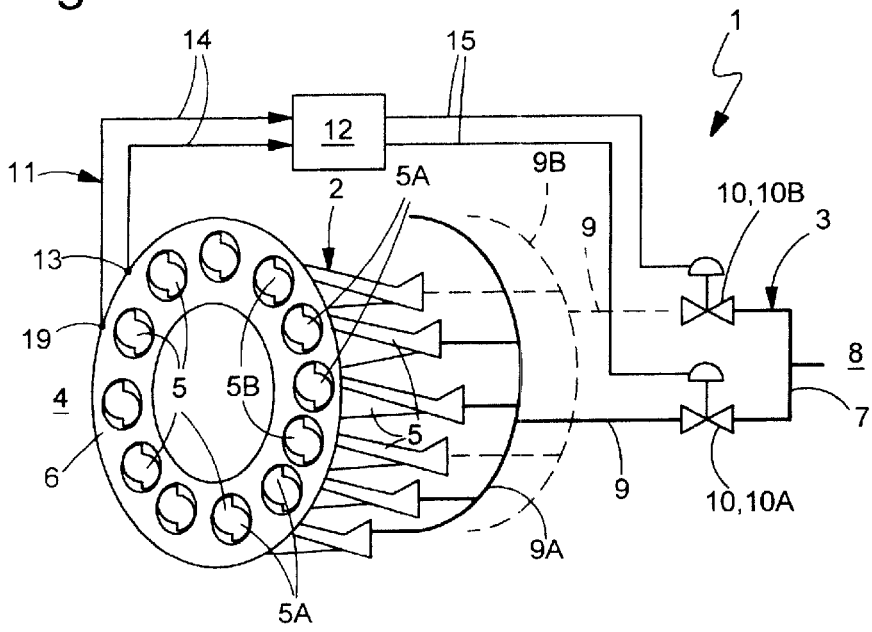
FIG. 1 to 4 each schematically show a much simplified, connection diagram-like, basic presentation of a combustor according to the invention, in different embodiments.

FIG. 1 correspondingly includes a combustor 1 embodying principles of the invention of a gas turbine which is not shown in the rest of the drawing, a burner system 2, a fuel supply system 3, and also a combustion chamber 4 with an annular configuration. The burner system 2 includes a plurality of burners 5 which are installed at an inlet 6 of the combustion chamber 4 and distributed in the circumferential direction. In addition, the burner system 2 includes a plurality of burner groups A and B, to which is allocated at least one of the burners 5 in each case. In the exemplary embodiment of FIG. 1, two burner groups A and B are provided, to which are allocated a plurality of burners 5 in each case. In FIG. 1, the burners 5 of the one burner group A are designated by 5A, while the burners 5 of the other burner group B are designated by 5B.

The fuel supply system 3 includes a main line 7 which is connected to a fuel source 8, which is not shown in detail. Furthermore, for each burner group A, B the fuel supply system 3 includes an auxiliary line 9, which are each designated likewise by 9A or by 9B respectively, according to their allocation to the respective burner group A, B. Accordingly, two auxiliary lines 9A, 9B are provided in this case, which in each case are connected to each burner 5 of the associated burner group A or B respectively. For example, the auxiliary lines 9 are formed as ring mains directly before the burners 5. Furthermore, the auxiliary lines 9 are connected to the main line 7 by a distribution valve 10 in each case. The distribution valves 10 are designated likewise by 10A or 10B respectively, according to their association with one of the burner groups A, B.

The combustor 1 according to the invention also includes a sensing system 11 which is connected to a control system 12. The sensing system 11 is designed so that for each burner group A, B it can separately measure pressure pulsation values, which correlate to pressure pulsations of the respective burner group A, B which occur in the combustion chamber 4, and/or can measure emission values, which correlate to pollutant emissions, especially to $NO_x$ emissions, of the respective burner group A, B. For example, the sensing system 11 for this purpose is equipped with at least one pressure sensor 19 and at least one emission sensor 13, for each burner group A, B. The individual sensors 13, 19 are in communication with the control system 12 by corresponding signal lines 14. It is clear that the sensing system 11 can allocate even more pressure sensors 19 or even more emission sensors 13, as the case may be, to each burner group A, B. The sensing system 11 can especially have one pressure sensor 19 and one emission sensor 13 separately for each individual burner 5.

The control system 12 serves for operation of the distribution valves 10, and for this purpose is connected to these by corresponding control lines 15. The control system 12 is designed so that it can operate the distribution valves 10 in dependence upon the determined pulsation values, and/or in dependence upon the determined emission values. As a result, this operation according to the invention takes place so that in each burner group A, B the pulsation values or emission values respectively assume or fall below predetermined threshold values, as the case may be. For this purpose, the control system 12 contains a suitable algorithm which determines outgoing control signals for operation of the distribution valves 10 from the incoming pulsation values and emission values.

In this case, it is important that the distribution valves 10A, 10B, which are allocated to the individual burner groups A, B, are individually controlled, i.e., the first distribution valve 10A which is allocated to the first burner group A is operated by the control system 12 in dependence upon the pressure pulsations or emissions respectively which occur in the first burner group A, while the second distribution valve 10B which is allocated to the second burner group B is controlled by the control system 12 in dependence upon pulsations or emissions respectively which occur in the second burner group B. Since the controlling of the distribution valves 10, moreover, takes place so that that variable which is responsible for the control process is varied as a result of it, the control system 12 in conjunction with the sensing system 11 forms a separate and closed control loop circuit for each burner group A, B. In each of these control loops, the pulsation value and/or the emission value are adjusted in dependence upon a nominal/actual comparison with predetermined threshold values.

In a preferred embodiment, these control loops, however, are not independent of each other, but on the contrary are intercoupled by at least one boundary condition. Preferably, the coupling of the control loops is effected by the condition of a total fuel flow which is to be fed as a whole through all the burners 5 to the combustion chamber 4. This total fuel flow is ultimately responsible for the performance of the combustor 1. As a result of the condition of a constant total fuel flow, the performance of the combustor 1 can be kept basically constant, even when its individual burner groups A, B are varied with regard to the partial fuel flow which is fed to the respective burner group A, B. As a result, these variations are realized by the control intervention of the control system 12 on the distribution valves 10 in dependence upon the pressure pulsations or the emissions respectively. Consequently, the combustor 1 according to the invention is particularly suitable for a stationary operation.

Owing to the individual closed-loop control of the individual burner groups A, B, an operating state for the combustor 1 can be especially effectively established, in which especially low emission values and/or especially low pressure pulsations occur so that the combustor 1 operates stably and with low emission of pollutants.

In a preferred embodiment, the control system 12 determines a proportional factor for each burner group A, B in dependence upon the measured pulsation values or emission values respectively. In this case, each proportional factor represents the portion of the total fuel flow which is fed to the associated burner groups A, B. The controlling of the distribution valves 10 then takes place in dependence upon these proportional factors and, therefore, not just indirectly in dependence upon the measured values for the pulsations and emissions. The controlling of the distribution valves 10 is simplified by the use of such proportional factors. Especially by this, a closed-loop control can also be especially simply realized, in which the total fuel flow remains constant also in the case of varying proportional factors. In the example with two burner groups A, B, for example a proportional factor of 20% is determined for the first burner group A. If the total fuel flow is to be kept constant, the sum of all proportional factors, therefore, must come to 100%, so that in this example the proportional factor of the second burner group B is 80%.

Figure 2:
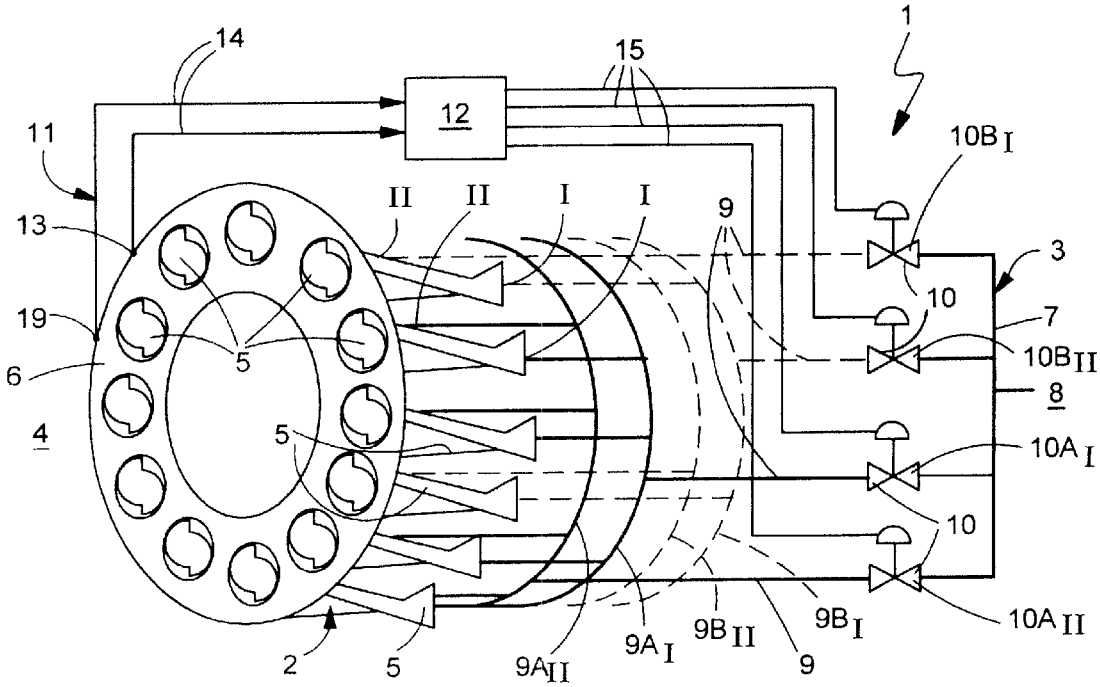

According to FIG. 2, the burner system 2 in another embodiment can again have 2 burner groups A and B. While in the embodiment according to FIG. 1 the individual burners 5, however, are of a single-stage design, the burners 5 in the variant according to FIG. 2 are of a multistage design, and in this case two-stage. In the exemplary embodiment which is shown, in both burner groups A, B all burners in each case are designed as multistage burners or two-stage burners 5, as the case may be. The individual burner stages I, II are recognizable in FIG. 2 by the fuel feed to the respective burner 5 taking place at different points. For example, each two-stage burner 5 has a first burner stage I with a basically axial and central fuel feed, and a second burner stage II with a basically eccentric and radial fuel feed. For example, the first burner stage I enables a pilot mode, and the second burner stage II enables a premix mode. Furthermore, it is possible to establish optional mixed operating states between the two aforementioned extreme operating modes.

The fuel supply system 3 has now for each burner group A, B, which has multistage burners 5, exactly the same number of auxiliary lines 9 as the burners 5 of this burner group A, B have burner stages I, II. In the example under consideration, therefore, two auxiliary lines 9 are provided within each burner group A, B, wherein each of these auxiliary lines 9 within these burner groups A, B is connected to the same burner stage I or II in all burners 5. That means that four auxiliary lines 9 are provided in the case under consideration, to be precise a first auxiliary line $\mathbf{9}A_I$ which connects the first burner stages I of the burner 5A in the first burner group A to the main line 7 by a first distribution valve $\mathbf{10}A_I$. In a corresponding way, a second auxiliary line $\mathbf{9}A_{II}$ within the first burner group A connects the second burner stage II to a second distribution valve $\mathbf{10}A_{II}$ in all burners 5A. Furthermore, a third auxiliary line $\mathbf{9}B_I$ connects the first burner stages I of the burner 5B within the second burner group B to a third distribution valve $\mathbf{10}B_I$, while a fourth auxiliary line $\mathbf{9}B_{II}$ in all burners 5B of the second burner group B connects their second burner stage II to a fourth distribution valve $\mathbf{10}B_{II}$.

The control system 12 in this embodiment is designed, therefore, so that it can control the distribution valves 10 in dependence upon the emission values or pulsation values respectively which are determined by the sensing system 11. By means of a corresponding apportioning of the fuel flow, which is fed to each one of the burner groups A, B, to the burner stages I, II of the respective burner group A, B, the thermoacoustic pulsation behaviour of the respective burners 5 can now be influenced in an effective way. In a corresponding way, the exhaust gas emission can also be influenced by an apportioning of the fuel flows to the burner stages I, II.

Separate, closed control loops for the individual burner stages I, II within the individual burner groups A, B, which enable an especially effective closed-loop control of the individual burners 5 with regard to the desired nominal values or threshold values for the pulsations and emissions, as the case may be, are also expediently created in this case.

In such an embodiment, it can also be necessary to keep the total fuel flow constant during the closed-loop control processes. Furthermore, it can be important to carry out the distribution of the fuel flow to the individual fuel stages I, II so that a constant fuel flow is constantly fed to the respective burner 5, so that the individual burner 5 has a constant burner performance. In this respect, the individual control loops can be intercoupled by the aforementioned boundary condition.

Figure 3:
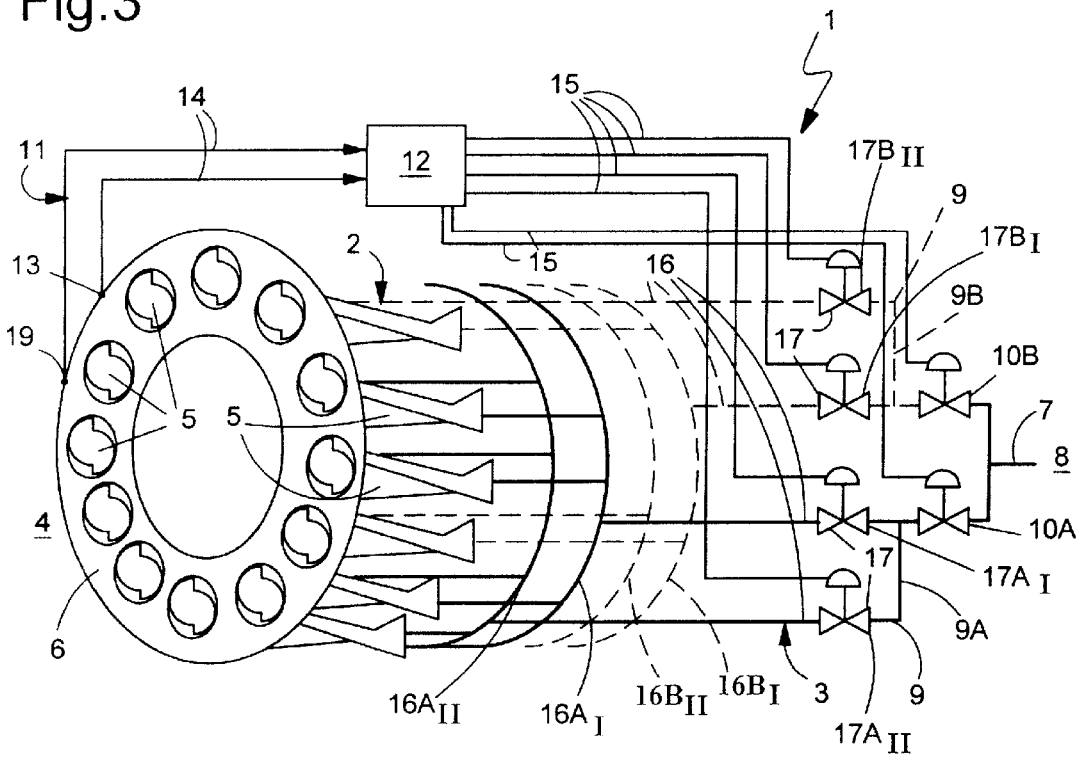

A simplified control can be achieved, as a result, in an embodiment according to FIG. 3, in which two burner groups A, B are also provided as in FIG. 2, the burners 5 of which are designed as two-stage burners with two burner stages I, II. The fuel supply system 3 in this case again has a separate auxiliary line 9A and 9B for each burner group A, B. Moreover, within each burner group A, B, a separate branch line 16 is also allocated to each burner stage I, II of the associated burner 5. The designation of the individual branch lines 16 in this case is made similarly to the designation of the individual auxiliary lines 9 in FIG. 2.

Accordingly, the first branch line $\mathbf{16}A_I$ is connected by a first branch valve $\mathbf{17}A_I$ to the first auxiliary line 9A, while the second branch line $\mathbf{16}A_{II}$ is connected likewise by a second branch valve $\mathbf{17}A_{II}$ to the first auxiliary line 9A. In variance with this, the third branch line $\mathbf{16}B_I$ is connected by a third branch valve $\mathbf{17}B_I$ to the second auxiliary line 9B, while the fourth branch line $\mathbf{16}B_{II}$ is connected by a fourth branch valve $\mathbf{17}B_{II}$ to the second auxiliary line 9B. The control system 12 can now control the apportioning of the total fuel flow to the two burner groups A, B by a corresponding operation of the two distribution valves 10A and 10B. Furthermore, the control system 12 can control the distribution of the allocated fuel flows to the two burner stages I, II by a corresponding operation of the branch valves 17 within the respective burner group A, B.

In all, an effective closed-loop control of the pressure pulsations and/or emissions can, therefore, be realized by the development of the combustor 1 according to the invention even in burner groups A, B which have multistage (I, II) burners 5.

Figure 4:
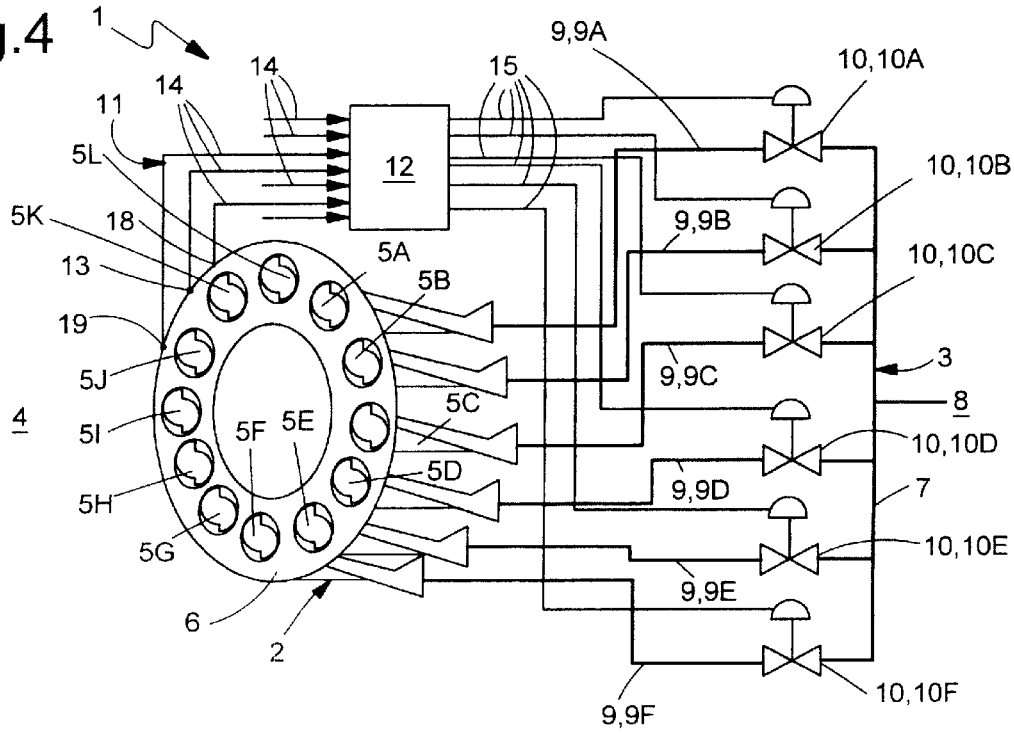

Although in the embodiments which are shown in FIG. 1 to 3 the burner system 2 has only two burner groups A, B in each case, in principle an embodiment with more than two burner groups A, B, C, D . . . is also possible. Furthermore, in an extreme case the respective burner group A, B can have only a single burner 5. FIG. 4 exemplarily shows an embodiment with twelve burner groups A to L, in which each burner group A to L is equipped with only a single burner 5A to 5L. In a corresponding way, the fuel supply system 3 then also includes twelve auxiliary lines 9, of which, however, only six, 9A to 9F, are exemplarily shown. Each auxiliary line 9 connects the associated burner 5A to 5L to the main line 7 by a corresponding distribution valve 10, or 10A to 10F, as the case may be. The sensing system 11 includes at least one pressure sensor 19 and at least one emission sensor 13 for each burner 5. In the embodiment which is shown here, at least one temperature sensor 18 is also allocated to each burner 5, by means of which a flame temperature inside the combustion chamber 4 can be determined in the region of the respectively allocated burner 5. Furthermore, a pressure sensor arrangement, which is not shown here, can also be provided, which allows a differential pressure measurement at each burner 5, by means of which the associated air mass flow at the respective burner 5 can be determined.

For the sake of clarity, only one of the sensors 13, 18, 19, is shown in each case, wherein in principle such a sensor arrangement can be provided for each burner 5, which is indicated by additional signal lines 14 to the control system 12.

According to a preferred embodiment, the sensing system 11 can now separately measure values for each burner 5, which correlate to the flame temperature and, alternatively or additionally, to an air mass flow at the respective burner 5. In dependence upon the determined temperature values or air mass flow values, as the case may be, the control system 12 can now determine control signals which serve for operation of the associated distribution valves 10A to 10F. The control system 12 expediently controls the distribution valves 10A to 10F so that a flame temperature distribution which is as homogenous as possible is formed in the combustion chamber 4. By means of the individual control of the individual burners 5A to 5L, compensation can be provided, for example for geometric deviations of the individual burners 5A to 5L, which, for example, go back to manufacturing tolerances. Accordingly, locally excessive temperatures and, therefore, a locally excessive $NO_x$ production, can be avoided.

LIST OF DESIGNATIONS

1 Combustor
2 Burner system
3 Fuel supply system
4 Combustion chamber
5 Burner
6 Combustion chamber inlet
7 Main line
8 Fuel source
9 Auxiliary line
10 Distribution valve
11 Sensing system
12 Control system
13 Emission sensor

14 Signal line
15 Control line
16 Branch line
17 Branch valve
18 Temperature sensor
19 Pressure sensor While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

The invention claimed is:

1. A combustor for a gas turbine comprising:

a burner system having a plurality of burners, wherein the burners are grouped into at least two burner groups, wherein each burner group has at least one burner;

a fuel supply system having a main line connectable to a fuel source;

a controllable distribution valve for each burner group connected to the fuel supply system, and auxiliary lines that connect each distribution valve to all burners in a group such that each distribution valve is enabled to vary the total fuel flow of a burner group;

a combustion chamber having an inlet at which the burners are positioned;

a sensing system configured and arranged, for each burner group, to separately measure values which correlate to pressure pulsations, to emissions, or to both, which occur in the combustion chamber; and a control system connected to the sensing system and connected to the distribution valves, the control system configured and arranged, in dependence upon the pulsation values, the emission values, or both, to control the distribution valves so that in each burner group the pulsation values, the emission values, or both, assume or fall below, predetermined threshold values.

2. The combustor as claimed in claim 1, wherein the control system together with the sensing system forms a control loop for each burner group in which an associated distribution valve is controlled in dependence upon a nominal/actual comparison of the pulsation values, of the emission values, or of both.

3. The combustor as claimed in claim 1, wherein the control system is configured and arranged, in dependence upon the pulsation values, upon the emission values, or upon both, to determine a proportional factor for each burner group which represents the portion of a predetermined total fuel flow to be fed to the combustion chamber which is fed to the respective burner group; and wherein the control system is configured and arranged to control the distribution valves in dependence upon the proportional factors.

4. The combustor as claimed in claim 3, wherein the control system is configured and arranged to control the distribution valves, determine the proportional factors, or both, so that a total fuel flow to be fed to the combustion chamber remains constant.

5. The combustor as claimed in claim 1, wherein the sensing system comprises at least one pressure sensor, at least one emission sensor, or both, for each burner group.

6. The combustor as claimed in claim 1, wherein each burner group has only one burner.

7. The combustor as claimed in claim 6,wherein the sensing system is configured and arranged to additionally separately measure values for each burner which correlate to a flame temperature, to an air mass flow, or to both, at a respective burner; and wherein the control system is configured and arranged to additionally control the distribution valves in dependence upon the flame temperature values, upon air mass flow values, or upon both, so that a homogeneous flame temperature distribution is formed in the combustion chamber.

8. The combustor as claimed in claim 7, wherein the sensing system comprises a temperature sensor, a pressure sensor, or both, arrangement for differential measurement for each burner.

9. The combustor as claimed in claim 1, wherein at least in one burner group all the burners comprise multistage burners with at least two burner stages each;

wherein the fuel supply system for each burner group with multistage burners has a number of auxiliary lines, each including a controllable distribution valve, which number of auxiliary lines corresponds to the number of burner stages, which auxiliary lines are each connected to an associated burner stage in all multistage burners of the associated burner group, and are connected by said controllable distribution valve to the main line; and wherein the control system is configured and arranged to control the distribution valves in dependence upon the pulsation values, upon the emission values, or upon both, so that in each burner group there ensues a distribution of the fuel flow to the individual burner stages selected so that in the respective burner group the pulsation values, the emission values, or both, assume, fall below, or both, the predetermined threshold values.

10. The combustor as claimed in claim 1, wherein at least in one burner group all the burners comprise multistage burners with at least two burner stages each;

wherein the fuel supply system for each burner group with multistage burners has a number of branch lines, each including a controllable branch valve, which number of branch lines corresponds to the number of burner stages, which branch lines are each connected to an associated burner stage in all multistage burners of an associated burner group, and are connected by said controllable branch valve to an auxiliary line allocated to the burner group; and wherein the control system is configured and arranged to additionally control the branch valves in dependence upon the pulsation values, upon the emission values, or upon both, so that in each burner group there ensues a distribution of the fuel flow to the individual burner stages selected so that in the respective burner group the pulsation values, the emission values, or both, assume, fall below, or both, the predetermined threshold values.

* * * * *